US006640512B1

(12) United States Patent
Kinnaman et al.

(10) Patent No.: US 6,640,512 B1
(45) Date of Patent: Nov. 4, 2003

(54) SIDING PANEL HANGING GUIDE TOOL

(76) Inventors: Charles T. Kinnaman, 2225 Ocean Beach Rd., Copalis Crossing, WA (US) 95836; Pamela Kinnaman, 2225 Ocean Beach Rd., Copalis Crossing, WA (US) 95836

( * ) Notice: Subject to any disclaimer, the term of this patent is extended or adjusted under 35 U.S.C. 154(b) by 0 days.

(21) Appl. No.: 10/134,967

(22) Filed: Apr. 30, 2002

(51) Int. Cl.[7] ..... E04B 2/30

(52) U.S. Cl. ..... 52/489.1; 52/509; 52/512; 248/300; 248/544

(58) Field of Search ..... 52/DIG. 1, 489.1, 52/512, 379, 509, 765, 549, 543; 248/304, 339, 307, 544, 300; D8/384

(56) References Cited

U.S. PATENT DOCUMENTS

| | | | | | |
|---|---|---|---|---|---|
| 1,661,251 | A | * | 3/1928 | Frey | |
| 3,380,215 | A | * | 4/1968 | Scaefer et al. | |
| 4,333,286 | A | | 6/1982 | Weinar | 52/281 |
| 4,587,789 | A | * | 5/1986 | Tomason | 52/713 |
| 4,599,831 | A | | 7/1986 | Magaha, Jr. | 52/98 |
| 4,831,808 | A | | 5/1989 | Wynar | 52/715 |
| 4,845,910 | A | | 7/1989 | Hanson et al. | 52/288 |
| D312,772 | S | | 12/1990 | Paul | D8/389 |
| D319,004 | S | | 8/1991 | Schenker | D8/382 |
| 5,222,343 | A | | 6/1993 | Anderson | 52/718.04 |
| D352,651 | S | | 11/1994 | Anderson et al. | D8/384 |
| D352,655 | S | | 11/1994 | Anderson et al. | D8/384 |
| 5,385,194 | A | * | 1/1995 | Brown | 160/354 |
| 5,884,447 | A | * | 3/1999 | Earp | 52/489.1 |

FOREIGN PATENT DOCUMENTS

| | | | |
|---|---|---|---|
| DE | 197 18 302 | A1 * | 5/1998 |
| FR | 2 760 769 | A1 * | 12/1997 |
| GB | 1079103 | | 8/1967 |
| WO | 99/66145 | * | 12/1999 |

* cited by examiner

*Primary Examiner*—Gwendolyn Baxter
(74) *Attorney, Agent, or Firm*—Donald R. Schoonover

(57) ABSTRACT

A siding panel is supported by a hanging guide while that siding panel is being maneuvered into a desired position with respect to a support surface. The hanger is attached to the support surface and includes a pocket which accommodates an edge of the siding panel. Once the siding panel is supported by the hanging guide, the siding panel is fixed to the support surface. Once the siding panel is fixed to the support surface, the hanging guide is removed.

5 Claims, 1 Drawing Sheet

SIDING PANEL HANGING GUIDE TOOL

BACKGROUND OF THE INVENTION

1. Field of the Invention

The present invention relates to the general art of tools, and to the particular field of specialized installation tools.

2. Discussion of the Related Art

Siding panels used on buildings often are long and unwieldy. Siding panels can be very cumbersome to handle and to maneuver into a desired position on the building. In many situations, it requires two or more workers to maneuver a siding panel into a desired position and then to fix that panel to the building.

Still further, it may be difficult for a worker to manipulate tools while supporting a siding panel. Again, the worker generally requires assistance.

In some instances, a worker must support himself on scaffolding or on a ladder while working with siding panels. This can be very difficult, and may even be dangerous in some instances if atmospheric conditions are windy or the like. In such cases, assistance is certainly required.

Such situations can be very wasteful of time and resources.

Therefore, there is a need for a means and a method for supporting a siding panel in a desired position and/or orientation with respect to a support structure.

There is a further need for a means and a method in which an individual worker working by himself or herself can support a siding panel in a desired position and/or orientation with respect to a support structure.

Many tools can be very expensive. Thus, a building job should not require a great number of expensive tools to complete. Thus, adding tools to an already formidable array of tools can be counter-productive if substantial cost is also added. Still further, it is often easier and less costly to have supports that can be reused over and over again, or that will not be overly expensive if lost.

Therefore, there is a need for a means and a method for supporting a siding panel in a desired position and/or orientation with respect to a support structure without the use of expensive tools or equipment.

Still further, the elements used to support siding panels should be easily storable and easily and conveniently carried on the worker so these elements will be readily available when necessary.

Therefore, there is a need for a means and a method for supporting a siding panel in a desired position and/or orientation with respect to a support structure using elements that are readily available when necessary.

Once held in position, it is necessary that the siding panel be securely held in position during the initial steps of fixing the panel to the support surface.

Therefore, there is a need for a means and a method for securely supporting a siding panel in a desired position and/or orientation with respect to a support structure.

PRINCIPAL OBJECTS OF THE INVENTION

It is a main object of the present invention to provide a means and a method for supporting a siding panel in a desired position and/or orientation with respect to a support structure.

It is another object of the present invention to provide a means and a method in which an individual worker can support a siding panel in a desired position and/or orientation with respect to a support structure.

It is another object of the present invention to provide a means and a method for supporting a siding panel in a desired position and/or orientation with respect to a support structure without the use of expensive tools or equipment.

It is another object of the present invention to provide a means and a method for supporting a siding panel in a desired position and/or orientation with respect to a support structure using elements that are readily available when necessary.

It is another object of the present invention to provide a means and a method for securely supporting a siding panel in a desired position and/or orientation with respect to a support structure.

SUMMARY OF THE INVENTION

These, and other, objects are achieved by a siding panel hanging guide tool that includes a one-piece body having a J-shape with a siding panel support section on one end thereof and a mounting block on the other end. Fasteners affix the block to the body and fasteners extend through the body and the mounting block to fix the hanging guide to a support surface, such as a wall of a building or the like.

Once the position and orientation of a siding panel is selected, the hanging guide of the present invention is fixed to the support surface and a siding panel is placed on the hanging guide to be supported thereby. The siding panel can then be fixed to the support structure while the panel is supported by the hanging guide. Once the siding panel is sufficiently supported on the support structure, the hanger can be removed from the support structure, and the remaining steps carried out to permanently fix the panel to the support surface. The hanger can then be reused to install the remaining siding panels. A worker can carry several of the hanging guides with him in case he should drop the hanging guide he is currently using.

In this manner, an individual worker can hang siding panels, by simply placing one or more hanging guides as needed to support the siding panels. There is no need for an assistant to hold the siding panel while that panel is being fixed to the support structure. This saves manpower, time and cost.

The hangers can be made of low cost materials, such as metal and plastic so they can be used and discarded without incurring significant costs.

DETAILED DESCRIPTION OF THE INVENTION

Other objects, features and advantages of the invention will become apparent from a consideration of the following detailed description and the accompanying drawings.

The siding panel supporting hanger embodying the present invention permits an individual worker to position, orient and attach a siding panel, which can be long and unwieldy, to a support structure without requiring the assistance of another worker. The siding panel hanging guide tool of the present invention is easily and quickly attached to the support structure in position to support the siding panel in the desired location and then frees the worker to handle the siding panel as well as any tools that are needed to fix the siding panel to the support structure. The present invention also includes a method of attaching a siding panel to a support structure using the siding panel hanging guide tool.

Figure 2:
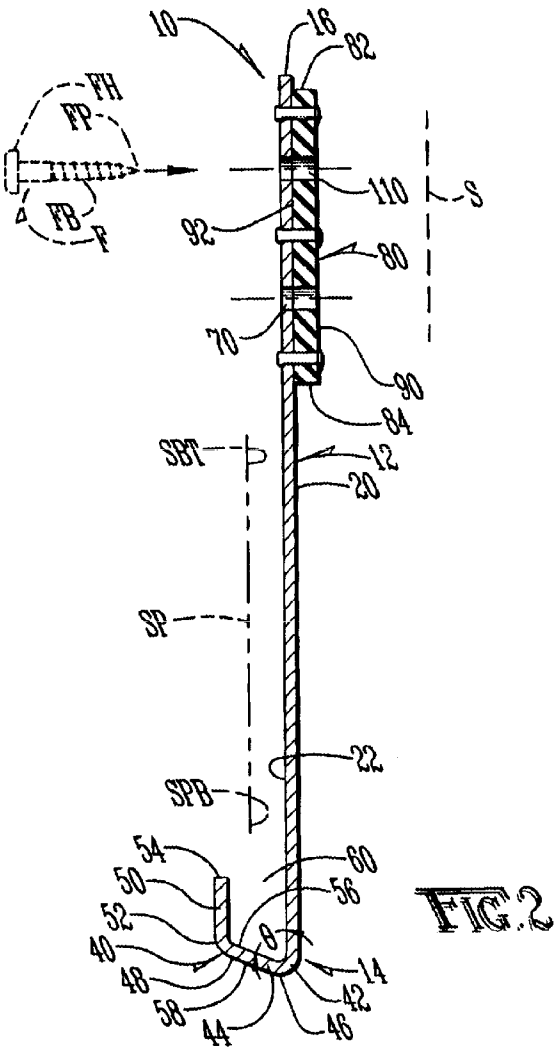
FIG. 2 is a side elevational view of the siding panel hanging guide tool, taken along line 2—2 of FIG. 1.
Figure 1:
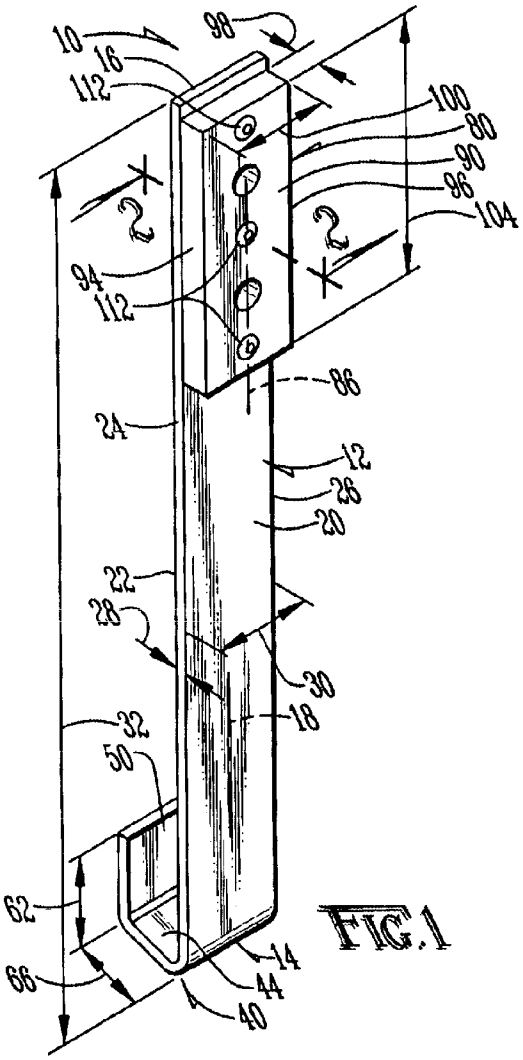
FIG. 1 is a perspective view of a siding panel hanging guide tool embodying the present invention.

Referring to FIGS. 1 and 2, it can be seen that a siding panel hanging guide tool 10 embodying the present invention is used to temporarily support a siding panel SP adjacent to a support surface or structure S while siding panel SP is being fixed to support structure S, such as a building wall or the like. Support structure S is shown only in dotted lines and siding panel SP is also shown only in dotted lines to indicate that there is no fixed form for these two items and supporting hanger 10 can be used with any suitable and desired siding panel and any suitable and desired support structure and no limitation is intended as to the particular form of either of these elements.

As shown in FIGS. 1 and 2, siding panel hanging guide tool 10 comprises a one-piece, monolithic body 12 having a distal end 14, a proximal end edge 16, and a longitudinal axis 18 extending between distal end 14 and proximal end edge 16. Body 12 further includes a front surface 20, a rear surface 22, a first side edge 24, a second side edge 26, a thickness dimension 28 measured between front surface 20 and rear surface 22 and a width dimension 30 measured between first side edge 24 and second side edge 26. Width dimension 30 and thickness dimension 28 are each uniform for the entire extent of body 12. A length dimension 32 is measured between distal end 14 and proximal end edge 16. Siding panel hanging guide tool 10 further includes a panel support section 40 on distal end 14 of body 12. Panel support section 40 includes a reverse bend 42 at distal end 14 of body 12, a bottom section 44 having first end 46 located at reverse bend 42 and a second end 48 spaced apart from rear surface 22 of body 12, a lip section 50 having one end 52 forming a portion of second end 48 of bottom section 44 of panel support section 40 and another end 54 free and spaced apart from rear surface 22 of body 12 and spaced apart from second end 48 of bottom section 44 of panel support section 40. Bottom section 44 has an inner surface 56 located adjacent to rear surface 22 of body 12 and an outer surface 58. Bottom section 44 of panel support section 40 is oriented at angle θ to rear surface 22 of body 12. Angle θ is an acute angle so bottom section 44 extends upwardly with respect to rear surface 22 as indicated in FIG. 2. Lip section 50 of panel support section 40 is oriented to be parallel to rear surface 22 of body 12. A pocket 60 is formed by lip section 50, bottom section 44 and rear surface 22 of body 12. The shape of pocket 60 ensures that a siding panel will be securely held in position. The acute angle distributes the forces associated with supporting the siding panel in a manner that ensures a secure support of the siding panel without requiring undue amounts of material for the hanger. Lip section 50 has a longitudinal dimension 62 measured between second end 48 of bottom section 44 of panel support section 40 and end 54 of lip section 50. Bottom section 44 of panel support section 40 has a longitudinal dimension 66 measured between first end 46 of bottom section 44 of panel support section 40 and second end 48 of bottom section 44 of panel support section 40. Longitudinal dimension 66 of bottom section 44 of panel support section 40 is greater than longitudinal dimension 62 of lip section 50 of panel support section 40.

Siding panel hanging guide tool 10 further includes a plurality of fastener-accommodating holes, such as hole 70, defined through body 12 from front surface 20 of body 12 to rear surface 22 of body 12 and which are aligned with each other along longitudinal axis 18 of body 12. Fasteners, such as fastener F, which can be a screw, a bolt, or the like, are used to fix hanger 10 to support S as will be discussed below.

Hanger 10 further includes a mounting block 80 fixedly secured to front surface 20 of body 12 adjacent to proximal end edge 16 of body 12. Mounting block 80 includes a first end edge 82, a second end edge 84, a longitudinal axis 86 extending between first end edge 82 of mounting block 80 and second end edge 84 of mounting block 80. Longitudinal axis 86 extends along longitudinal axis 18 of body 12. Mounting block 80 further includes a front surface 90 spaced apart from front surface 20 of body 12, a rear surface 92 in abutting contact with front surface 20 of body 12, a first side edge 94 located closely adjacent to first side edge 24 of body 12, a second side edge 96 located closely adjacent to second side edge 26 of body 12, a thickness dimension 98 measured between front surface 90 of mounting block 80 and rear surface 92 of mounting block 80, and a width dimension 100 measured between first side edge 94 of mounting block 80 and second side edge 96 of mounting block 80. First end edge 82 of mounting block 80 is located closely adjacent to and spaced from proximal end edge 16 of body 12. Mounting block 80 includes a length dimension 104 measured between first end edge 82 of mounting block 80 and second end edge 84 of mounting block 80. Length dimension 104 of mounting block 80 is less than length dimension 32 of body 12 so the mounting block fits neatly on the body in the location shown in FIGS. 1 and 2.

Thickness dimension 98 of mounting block 80 is greater than thickness dimension 28 of body 12 so the mounting block can provide support to the body when fasteners F are used to attach the body to a support element. Mounting block 80 further includes a plurality of fastener-accommodating holes, such as hole 110, defined through mounting block 80 from front surface 90 of mounting block 80 to rear surface 92 of mounting block 80 and are aligned with each other along longitudinal axis 86 of mounting block 80. Fastener-accommodating holes 110 of mounting block 80 are aligned with fastener-accommodating holes 70 of body 12 so fasteners F will extend through the body and through the mounting block from rear surface 22 of the body to front surface 90 of the mounting block. Fastener F has a head FH which will engage rear surface 22 of body 12 and a leading point FP and a body FB that will embed into support structure S to attach hanger 10 to support structure S.

If desired for some applications, hanging guide 10 further includes a plurality of fastener elements, such as fastener element 112 extending through mounting block 80 and through body 12 to fixedly secure mounting block 80 to body 12. Fastener elements 112 are spaced apart from each other and are located along longitudinal axis 86 of mounting block 80. Fastener elements 112 are spaced apart from fastener-accommodating holes 110 of mounting block 80 and are spaced apart from fastener-accommodating holes 70 of body 12.

A method of hanging a siding panel SP on a support surface S will include providing siding panel supporting hanger 10 as described above, providing siding panel SP having a bottom end edge SPB and a top end edge SBT. The end edges of the siding panel are not fully shown in FIG. 2 for the sake of clarity; however, those skilled in the art will be able to visualize these elements based on the teaching of this disclosure. The method further includes steps of locating the siding panel in a desired position adjacent to support surface S; locating the siding panel hanging guide tool adjacent to the bottom edge of the siding panel; orienting front face 20 of body 12 of the siding panel hanging guide tool and front face 90 of mounting block 80 to be adjacent to support surface S and to be located between the support surface and rear surface 22 of body 12 of the siding panel hanging guide tool; maneuvering the siding panel hanging guide tool until the bottom end edge of the siding panel is accommodated in panel support section 40 of the siding panel hanging guide tool and is supported on bottom section 44 of the panel support section of the siding panel hanging guide tool; extending fastener elements F through fastener-accommodating holes 110 and 70 in the mounting block and in the body respectively and into the support surface and fixing the siding panel hanging guide tool to the support surface in position to support the siding panel. The method then includes a step of attaching the siding panel to the support surface. Once the siding panel is fixed to the support surface, the siding panel hanging guide tool is removed for reuse.

It is noted that body 12 of hanger 10 can be formed of metal and mounting block 80 can be formed of plastic or other suitable material.

It is understood that while certain forms of the present invention have been illustrated and described herein, it is not to be limited to the specific forms or arrangements of parts described and shown.

We claim:

1. A siding panel hanging guide tool comprising:

a) a one-piece, monolithic body having
- (1) a distal end,
- (2) a proximal end edge,
- (3) a longitudinal axis extending between the distal end and the proximal end edge,
- (4) a front surface,
- (5) a rear surface,
- (6) a first side edge,
- (7) a second side edge,
- (8) a thickness dimension measured between the front surface and the rear surface,
- (9) a width dimension measured between the first side edge and the second side edge,
- (10) the width dimension and the thickness dimension each being uniform for the entire extent of said body,
- (11) a length dimension measured between the distal end and the proximal end edge,
- (12) a panel support section on the distal end of said body and which includes
  - (A) a reverse bend at the distal end of said body,
  - (B) a bottom section having first end thereof located at the reverse bend and a second end thereof spaced apart from the rear surface of said body,
  - (C) a lip section having one end thereof forming a portion of the second end of the bottom section of the panel support section and another end free and spaced apart from the rear surface of said body and spaced apart from the second end of the bottom section of the panel support section,
  - (D) the bottom section having an inner surface located adjacent to the rear surface of said body and an outer surface,
  - (E) the bottom section of said panel support section being oriented at an acute angle to the rear surface of said body,
  - (F) the lip section of said panel support section being parallel to the rear surface of said body,
  - (G) the lip section having a longitudinal dimension measured between the second end of the bottom section of said panel support section and the another end of the lip section,
  - (H) the bottom section of said panel support section having a longitudinal dimension measured between the first end of the bottom section of said panel support section and the second end of the bottom section of said panel support section, and
  - (I) the longitudinal dimension of the bottom section of said panel support section being greater than the longitudinal dimension of the lip section of said panel support section,
- (13) a plurality of fastener-accommodating holes defined through said body from the front surface of said body to the rear surface of said body and which are aligned with each other along the longitudinal axis of said body;

b) a mounting block fixedly secured to the front surface of said body adjacent to the proximal end edge of said body and which includes
- (1) a first end edge,
- (2) a second end edge,
- (3) a longitudinal axis extending between the first end edge of said mounting block and the second end edge of said mounting block and extending along the longitudinal axis of said body,
- (4) a front surface spaced apart from the front surface of said body,
- (5) a rear surface in abutting contact with the front surface of said body,
- (6) a first side edge located closely adjacent to the first side edge of said body,
- (7) a second side edge located closely adjacent to the second side edge of said body,
- (8) a thickness dimension measured between the front surface of said mounting block and the rear surface of said mounting block,
- (9) a width dimension measured between the first side edge of said mounting block and the second side edge of said mounting block,
- (10) the first end edge of said mounting block being located closely adjacent to and spaced from the proximal end edge of said body,
- (11) a length dimension measured between the first end edge of said mounting block and the second end edge of said mounting block,
- (12) the length dimension of said mounting block being less than the length dimension of said body,
- (13) the thickness dimension of said mounting block being greater than the thickness dimension of said body,
- (14) a plurality of fastener-accommodating holes defined through said mounting block from the front surface of said mounting block to the rear surface of said mounting block and which are aligned with each other along the longitudinal axis of said mounting block, and
- (15) the fastener-accommodating holes of said mounting block being aligned with the fastener-accommodating holes of said body; and c) fastener elements extending through said mounting block and through said body fixedly securing said mounting block to said body, said fastener elements being spaced apart from each other and located along the longitudinal axis of said mounting block, the fastener elements being spaced apart from the fastener-accommodating holes of said mounting block and from the fastener-accommodating holes of said body.

2. The siding panel hanging guide tool as described in claim 1 wherein said mounting block is plastic.

3. The siding panel hanging guide tool as described in claim 2 wherein said body is metal.

4. The siding panel hanging guide tool as described in claim 1 further including a siding panel having a bottom end edge and a top end edge, with the bottom end edge of said siding panel being accommodated in said panel support section and said siding panel being supported on the bottom section of said panel support section.

5. A method of hanging a siding panel on a structure comprising:

a) providing a siding panel hanging guide tool comprising a one-piece, monolithic body having a distal end, a proximal end edge, a longitudinal axis extending between the distal end and the proximal end edge, a front surface, a rear surface, a first side edge, a second side edge, a thickness dimension measured between the front surface and the rear surface, a width dimension measured between the first side edge and the second side edge, the width dimension and the thickness dimension each being uniform for the entire extent of said body, a length dimension measured between the distal end and the proximal end edge, a panel support section on the distal end of said body and which includes a reverse bend at the distal end of said body, a bottom section having first end thereof located at the reverse bend and a second end thereof spaced apart from the rear surface of said body, a lip section having one end thereof forming a portion of the second end of the bottom section of the panel support section and another end free and spaced apart from the rear surface of said body and spaced apart from the second end of the bottom section of the panel support section, the bottom section having an inner surface located adjacent to the rear surface of said body and an outer surface, the bottom section of said panel support section being oriented at an acute angle to the rear surface of said body, the lip section of said panel support section being parallel to the rear surface of said body, the lip section having a longitudinal dimension measured between the second end of the bottom section of said panel support section and the other end of the lip section, the bottom section of said panel support section having a longitudinal dimension measured between the first end of the bottom section of said panel support section and the second end of the bottom section of said panel support section, and the longitudinal dimension of the bottom section of said panel support section being greater than the longitudinal dimension of the lip section of said panel support section, a plurality of fastener-accommodating holes defined through said body from the front surface of said body to the rear surface of said body and which are aligned with each other along the longitudinal axis of said body; a mounting block fixedly secured to the front surface of said body adjacent to the proximal end edge of said body and which includes a first end edge, a second end edge, a longitudinal axis extending between the first end edge of said mounting block and the second end edge of said mounting block and extending along the longitudinal axis of said body, a front surface spaced apart from the front surface of said body, a rear surface in abutting contact with the front surface of said body, a first side edge located closely adjacent to the first side edge of said body, a second side edge located closely adjacent to the second side edge of said body, a thickness dimension measured between the front surface of said mounting block and the rear surface of said mounting block, a width dimension measured between the first side edge of said mounting block and the second side edge of said mounting block, the first end edge of said mounting block being located closely adjacent to and spaced from the proximal end edge of said body, a length dimension measured between the first end edge of said mounting block and the second end edge of said mounting block, the length dimension of said mounting block being less than the length dimension of said body, the thickness dimension of said mounting block being greater than the thickness dimension of said body, a plurality of fastener-accommodating holes defined through said mounting block from the front surface of said mounting block to the rear surface of said mounting block and which are aligned with each other along the longitudinal axis of said mounting block, and the fastener-accommodating holes of said mounting block being aligned with the fastener-accommodating holes of said body; and fastener elements extending through said mounting block and through said body fixedly securing said mounting block to said body, said fastener elements being spaced apart from each other and located along the longitudinal axis of said mounting block, the fastener elements being spaced apart from the fastener-accommodating holes of said mounting block and from the fastener-accommodating holes of said body;

b) providing a siding panel having a bottom end edge and a top end edge;

c) locating the siding panel in a desired position adjacent to a support surface;

d) locating the siding panel hanging guide tool adjacent to the bottom edge of the siding panel;

e) orienting the front face of the body of the siding panel supporting hanger and the front face of the mounting block to be adjacent to the support surface and to be located between the support surface and the rear surface of the body of the siding panel hanging guide tool;

f) maneuvering the siding panel hanging guide tool until the bottom end edge of the siding panel is accommodated in the panel support section of the siding panel hanging guide tool and is supported on the bottom section of the panel support section of the siding panel hanging guide tool;

g) extending the fastener elements through the fastener-accommodating holes in the mounting block and in the body and into the support surface and fixing the siding panel supporting hanger to the support surface in position to support the siding panel;

h) attaching the siding panel to the support surface; and i) removing the siding panel hanging guide tool after the siding panel has been attached to the support surface.

* * * * *